United States Patent [19]

Melnyk

[11] Patent Number: 4,546,823

[45] Date of Patent: Oct. 15, 1985

[54] SOLDERLESS RADIATOR

[75] Inventor: William Melnyk, Lathrup Village, Mich.

[73] Assignee: McCord Heat Transfer Corporation, Walled Lake, Mich.

[21] Appl. No.: 700,212

[22] Filed: Feb. 11, 1985

[51] Int. Cl.[4] ..... F28F 9/02

[52] U.S. Cl. ..... 165/149; 165/173; 165/906

[58] Field of Search ..... 165/149, 173, 175, DIG. 9

[56] References Cited

U.S. PATENT DOCUMENTS

| | | | |
|---|---|---|---|
| 4,324,290 | 4/1982 | Moranne | 165/173 |
| 4,461,348 | 7/1984 | Toge et al. | 165/173 |
| 4,485,867 | 12/1984 | Melnyk et al. | 165/173 |

FOREIGN PATENT DOCUMENTS

| | | | |
|---|---|---|---|
| 497144 | 8/1954 | Italy | 165/149 |
| 48309 | 9/1983 | Japan | 165/149 |
| 48312 | 12/1983 | Japan | 165/149 |

*Primary Examiner*—Sheldon J. Richter

[57] ABSTRACT

There is disclosed herein a radiator wherein grooves formed in a tank flange and in a header match each other and a mound formed on an associated clamping strip. Tapered edges formed on locking tabs cut in the tank flange cooperate with a sloped surface on the clamping strip when bent inwardly to urge the clamping strip and header toward the tank flange so as to compress a sealing gasket between the header and tank flange grooves, eliminating the need for solder.

2 Claims, 5 Drawing Figures

SOLDERLESS RADIATOR

TECHNICAL FIELD

This invention relates generally to radiator assemblies and, more specifically, to a solderless tank to header joint arrangement therefor.

BACKGROUND ART

Heretofore, various solderless radiator tank to header joint arrangements have been used, as shown in FIGS. 1–4, and described in U.S. Pat. Nos. 4,485,867; 4,378,174; and 4,351,390; and British Pat. No. 699,032. Each of these prior art arrangements rely primarily on portions of the edges of their respective headers, or associated separate clips, being bent onto flanges formed on the respective tanks, to thereby compress an "O"-ring or other shaped resilient gasket between the tank and the header. Typically, headers are formed of a lighter gauge metal than tanks, or the tanks are formed of a suitable plastic with heavy gauge headers.

DISCLOSURE OF THE INVENTION

It is a general object of the invention to provide an improved solderless metal tank to header joint for a radiator.

Another object of the invention is to provide an improved solderless tank to header radiator joint, wherein a separate clamping strip cooperates with the tank and a conventional gauge header to assure an efficient seal with a gasket therebetween.

A further object of the invention is to provide a solderless tank to header radiator joint, wherein each of the tank and header and a separate clamping strip are similarly contoured for cooperating to compress an intermediate sealing gasket between the contoured sections, as a result of bending tapered tabs formed in the tank flange into wedging engagement with a sloped bottom surface of the clamping strip.

These and other objects and advantages of the invention will be apparent from the following drawings and accompanying description.

BEST MODE OF CARRYING OUT THE INVENTION

Figure 1:
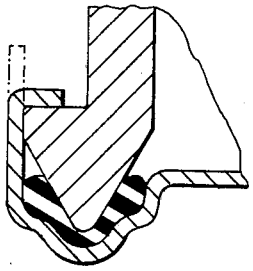
FIG. 1 PRIOR ART
FIGS. 1–4 are fragmentary cross-sectional views of four different prior art arrangements.
Figure 2:
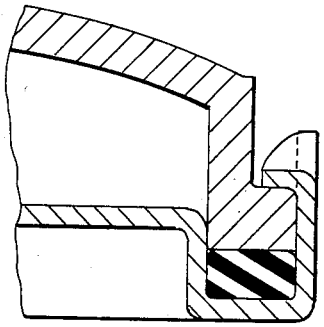
FIG. 2 PRIOR ART
Figure 3:
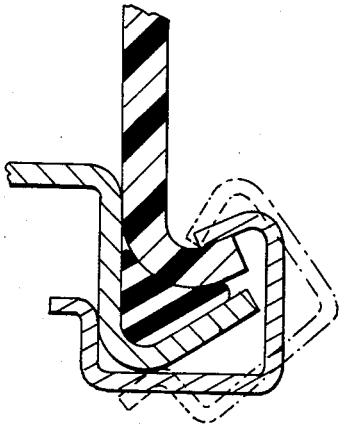
FIG. 3 PRIOR ART
Figure 4:
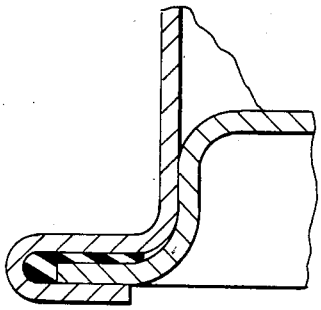
FIG. 4 PRIOR ART
Figure 5:
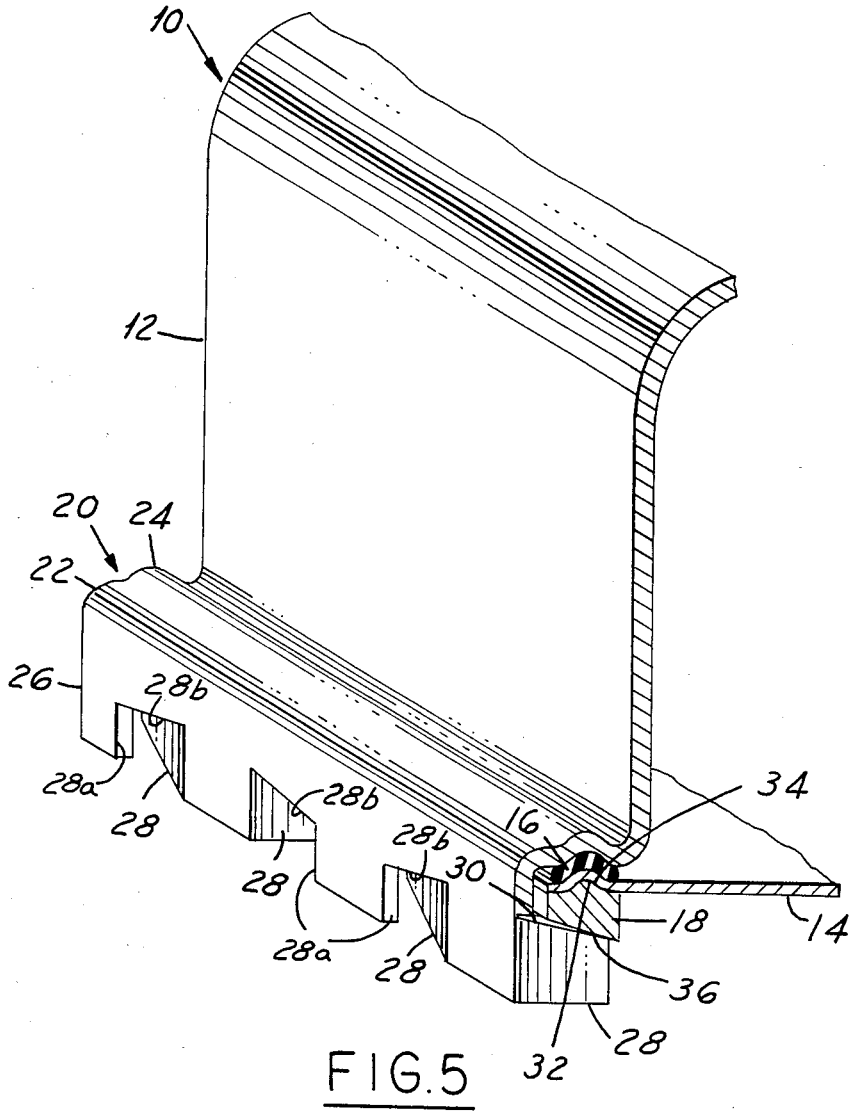
FIG. 5 is a fragmentary cross-sectional view of a radiator embodying the invention.

Referring now to the drawings in greater detail, FIG. 5 illustrates a radiator 10 including generally a tank 12, a header 14, a sealing gasket 16, and a clamping strip 18, joined together without the benefit of solder.

Specifically, the tank 12 includes an integral mounting skirt 20 consisting of a lateral flange portion 22 having an outwardly directed groove 24 formed therein, and a vertical flange portion 26 having spaced, bendable locking tabs 28 formed along the free edge thereof by virtue of interconnecting vertical and lateral cuts 28*a* and 28*b*, respectively, made therein. The lateral cut 28*b* is made upwardly from the vertical cut 28*a* such that a tapered upper edge 30 is formed on each locking tab 28.

A bend or A groove 32, comparable in shape to that of the tank flange groove 24, is formed in the header 14 a predetermined distance from the peripheral edge thereof. A mound or protrusion 34, comparable in shape to that of the grooves 24 and 32, is formed substantially along the center line of the upper surface of the clamping strip 18, while a sloped surface 36 is formed on the bottom of the strip 18. The degree of slope of the surface 36 and the degree of the taper of the upper edge 30 of the tabs 28 differ slightly from one another such that inward pivotal movement of the tabs 28 against the sloped surface 36 progressively urges the clamping strip 18 upwardly in FIG. 5.

The sealing gasket 16 is initially a flat, rectangular cross-sectioned strip but, after being positioned between the tank skirt 20 and the edge once the locking tabs 28 are bent inwardly against the sloped surface 36 of the clamping strip 18, the gasket is confined between the groove 24 of the tank flange portion 22 and the protrusion formed by the groove 32 in the header 14, to thereby assume a bowed shape as shown in FIG. 5. A predetermined amount of compression of the gasket 16 will have occurred by the time the tapered tabs 28 have been bent into full engagement with the sloped surface 36 of the clamping strip 18, moving the latter upwardly toward the tank skirt 20 as explained above.

Industrial Applicability

It should be apparent that the result of the above described arrangement is a tank 12 and a header 14 having a solderless, sealed joint therebetween, which may be quickly and efficiently assembled, and then, if necessary, readily disassembled for repair and reassembled.

While but one embodiment of the invention has been shown and described, other modifications thereof are possible within the scope of the following claims.

The embodiments of the invention in which an exclusive property or privilege is claimed are defined as follows:

1. A radiator comprising a tank having a mounting skirt formed at the lower end thereof, said mounting skirt including a first flange portion extending laterally therefrom and a second flange portion extending vertically downwardly from said first flange portion, a longitudinal groove formed along said first flange portion, and spaced tabs cut in the free edge of the second flange portion, each of said tabs having a tapered upper edge; a header having a groove formed adjacent the peripheral edge thereof such that the protrusion side of the groove substantially exactly matches said longitudinal groove; a clamping strip having a mound formed on the upper surface thereof substantially exactly matching said groove in said header, and a slope formed on the bottom surface thereof; and a sealing gasket confined between said protrusion side of said groove in said first flange and said longitudinal groove, and compressed therebetween by virtue of said tapered tabs being bent inwardly against said sloped bottom surface of said clamping strip.

2. A radiator comprising a tank having a mounting skirt formed at the lower end thereof, said mounting skirt including a longitudinal groove formed along a first portion thereof, and spaced tabs cut in a second free edge portion thereof, each of said tabs having a tapered upper edge; a header having a bend formed adjacent the peripheral edge thereof substantially exactly matching said longitudinal groove; a clamping strip having a mound formed on the upper surface thereof substantially exactly matching said bend in said header, and a slope formed on the bottom surface thereof; and a sealing gasket confined between said bend in said header and said longitudinal groove in said tank mounting skirt, and compressed therebetween by virtue of said tapered tabs being bent inwardly against said sloped bottom surface of said clamping strip.

* * * * *